US009837745B2

(12) United States Patent
Sasaki et al.

(10) Patent No.: US 9,837,745 B2
(45) Date of Patent: Dec. 5, 2017

(54) CONNECTOR TERMINAL WITH ONE OR MORE TOP SIDE CONTACT PORTIONS AND THREE LINEAR BOTTOM SIDE CONTACT PORTIONS

(71) Applicant: Japan Aviation Electronics Industry, Limited, Tokyo (JP)

(72) Inventors: Takuo Sasaki, Tokyo (JP); Osamu Hashiguchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/428,670

(22) Filed: Feb. 9, 2017

(65) Prior Publication Data

US 2017/0310032 A1 Oct. 26, 2017

(30) Foreign Application Priority Data

Apr. 21, 2016 (JP) ..... 2016-085466

(51) Int. Cl.
*H01R 11/22* (2006.01)
*H01R 13/11* (2006.01)

(52) U.S. Cl.
CPC ..... *H01R 13/113* (2013.01)

(58) Field of Classification Search
CPC ..... H01R 13/15; H01R 13/187
USPC ..... 439/852, 858, 861
See application file for complete search history.

(56) References Cited

U.S. PATENT DOCUMENTS 3,142,891 A * 8/1964 Travis ..... H01R 43/16 29/874
4,400,051 A * 8/1983 Stenz ..... H01R 13/02 439/603
4,992,062 A * 2/1991 Nakayama ..... H01H 85/2035 439/620.26
2010/0197177 A1 8/2010 Myer et al.
2013/0109250 A1 5/2013 Haga

FOREIGN PATENT DOCUMENTS

JP 2013-098088 A 5/2013
WO WO2011/125757 A1 10/2011

* cited by examiner

*Primary Examiner* — Phuong Dinh
(74) *Attorney, Agent, or Firm* — Muncy, Geissler, Olds & Lowe, P.C.

(57) ABSTRACT

A connector terminal includes a top side contact portion which makes contact with a top surface of a counter connector terminal and three linear bottom side contact portions each of which extends along a fitting axis and makes contact with a bottom surface of the counter connector terminal, the three bottom side contact portions being arranged such that centers of themselves form an isosceles triangle, the top side contact portion being, when viewed in a direction perpendicular to the top surface of the counter connector terminal in a fitted state, positioned in a straight line that lies between a base and a vertex facing the base in the triangle and extends parallel to the base in a manner that a ratio of a distance from the base to a distance from the vertex is 1:2.

7 Claims, 4 Drawing Sheets

CONNECTOR TERMINAL WITH ONE OR MORE TOP SIDE CONTACT PORTIONS AND THREE LINEAR BOTTOM SIDE CONTACT PORTIONS

BACKGROUND OF THE INVENTION

The present invention relates to a connector terminal, particularly to a connector terminal that, when being fitted with a counter connector terminal, which has a flat plate shape and has top and bottom surfaces, along a fitting axis so that its contact portions corresponding to the top and bottom surfaces of the counter connector terminal come into contact with the top and bottom surfaces, enables the electric connection with the counter connector terminal to be established.

In electric wiring using, for instance, a wire harness for vehicles, a connector has heretofore widely been used which establishes the electric connection when a plug terminal in a flat plate shape is inserted into a socket terminal in a box shape so that the plug terminal is sandwiched from top and bottom between a plurality of contact portions of the socket terminal.

For instance, JP 2013-98088 A discloses a connector terminal in which a socket terminal 1 has three elongate convex contact portions 2A to 2C formed on an inner facing contact surface 2 and one dome-shaped embossed contact 3A formed on a resilient contact piece 3 and a flat plug terminal 4 is sandwiched between the elongate convex contact portions 2A to 2C and the dome-shaped embossed contact 3A, as shown in FIG. 11.

As shown in FIG. 12, the three elongate convex contact portions 2A to 2C of the socket terminal 1 are disposed on the inner facing contact surface 2 so as to be located at three vertices of a triangle, and the dome-shaped embossed contact 3A is located in a central portion of the triangle formed by the three elongate convex contact portions 2A to 2C and at a substantially equal distance from any of the three elongate convex contact portions 2A to 2C.

When the plug terminal 4 is fitted with the socket terminal 1, the elongate convex contact portions 2A to 2C of the socket terminal 1 come into contact with a top surface 4A of the plug terminal 4, while the dome-shaped embossed contact 3A of the socket terminal 1 comes into contact with a bottom surface 4B of the plug terminal 4, whereby the electric connection is established between the socket terminal 1 and the plug terminal 4.

In the connector terminal described in JP 2013-98088 A and shown in FIGS. 11 and 12, when the socket terminal 1 and the plug terminal 4 are fitted with each other, the dome-shaped embossed contact 3A formed on the resilient contact piece 3 of the socket terminal 1 comes into contact with the bottom surface 4B of the plug terminal 4, so that the plug terminal 4 is elastically pressed against the inner facing contact surface 2 of the socket terminal 1, and accordingly, a load is exerted from the top surface 4A of the plug terminal 4 to each of the three elongate convex contact portions 2A to 2C formed on the inner facing contact surface 2 of the socket terminal 1.

When loads acting on the three elongate convex contact portions 2A to 2C are unequal, the contact resistance between each of the elongate convex contact portions 2A to 2C and the top surface 4A of the plug terminal 4 varies, which may cause heat to be locally generated.

SUMMARY OF THE INVENTION

The present invention aims at removing the drawback described above and providing a connector terminal that can reduce the variance in contact resistance among a plurality of contact portions that make contact with a counter connector terminal in a flat plate shape, thereby preventing heat from being locally generated.

A connector terminal according to the present invention is one that, when being fitted along a fitting axis with a counter connector terminal in a flat plate shape having a top surface and a bottom surface such that its contact points separately corresponding to the top surface and the bottom surface of the counter connector terminal come into contact with the top surface and the bottom surface, establishes an electric connection with the counter connector terminal, and the connector terminal comprises:

one or more top side contact portions each of which makes contact with the top surface of the counter connector terminal; and three bottom side contact portions each of which is linear, extends along the fitting axis, and makes contact with the bottom surface of the counter connector terminal, wherein the three bottom side contact portions are arranged such that centers of the three bottom side contact portions form an isosceles triangle, and wherein the one or more top side contact portions are, when viewed in a direction perpendicular to the top surface of the counter connector terminal in a fitted state, positioned in a straight line that lies between a base of the isosceles triangle and a vertex of the isosceles triangle facing the base and extends parallel to the base in such a manner that a ratio of a distance from the base to a distance from the vertex is 1:2.

DETAILED DESCRIPTION OF THE INVENTION

Embodiments of the present invention are described below based on the appended drawings.

Embodiment 1

Figure 1:
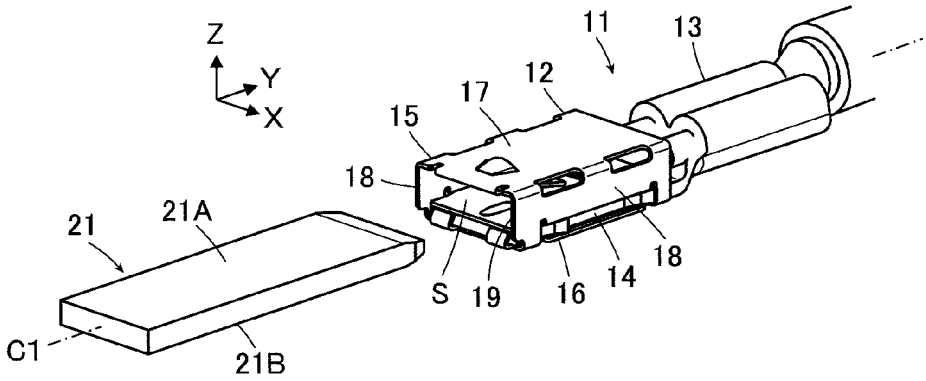
FIG. 1 is a perspective view showing a connector terminal according to Embodiment 1 and a counter connector terminal in the non-fitted state.

As shown in FIG. 1, a connector terminal 11 according to Embodiment 1 of the invention is a socket terminal including a socket portion 12 in a box shape having formed therein a counter connector terminal accommodating portion S, and a counter connector terminal 21 is a plug terminal in a flat plate shape. When the counter connector terminal 21 is inserted into the counter connector terminal accommodating portion S of the socket portion 12 of the connector terminal 11 along a fitting axis C1, the connector terminal 11 and the counter connector terminal 21 are fitted with each other, thus establishing the electric connection.

The connector terminal 11 includes an electric wire holding portion 13 that is formed at the back end of the socket portion 12 along the fitting axis C1 to be integral with the socket portion 12.

The socket portion 12 includes a base member 14 integral with the electric wire holding portion 13 and a housing 15 retaining the base member 14 and covering the outer periphery of the base member 14. The base member 14 and the housing 15 are each made of a conductive material such as a metal. The base member 14 has a flat plate shape.

The housing 15 includes a bottom plate portion 16, a ceiling portion 17 facing the bottom plate portion 16 in parallel therewith, and a pair of lateral wall portions 18 each of which connects either lateral end of the bottom plate portion 16 to the corresponding lateral end of the ceiling portion 17. The housing 15 is thus in a box shape which is open at the front and back ends in the direction of the fitting axis C1. The base member 14 is fixed to a surface of the bottom plate portion 16 of the housing 15 configured as above.

At the front end of the socket portion 12 opposite from the end at which the electric wire holding portion 13 is located, the open front end of the housing 15 constitutes an insertion port 19 for receiving the counter connector terminal 21.

For ease of understanding, a plane along which the bottom plate portion 16 and ceiling portion 17 of the housing 15 extend is called "XY plane," a plane along which the lateral wall portions 18 extend "YZ plane," a direction in which the fitting axis C1 extends from the socket portion 12 toward the electric wire holding portion 13 "+Y direction," and a direction from the bottom plate portion 16 of the housing 15 toward the ceiling portion 17 thereof "+Z direction."

The counter connector terminal 21 is of a flat plate shape having a uniform thickness and extending along an XY plane. The counter connector terminal 21 includes a top surface 21A extending along the XY plane and facing in the +Z direction and a bottom surface 21B extending along the XY plane in parallel with the top surface 21A and facing in the −Z direction.

Figure 2:
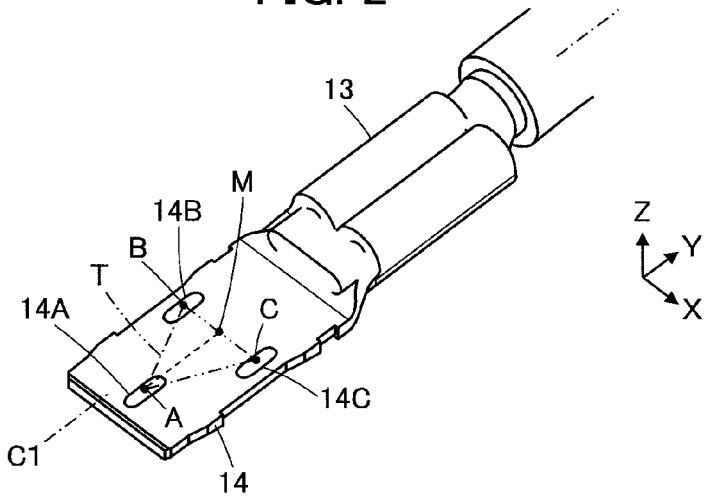
FIG. 2 is a perspective view showing a base member on which bottom side contact portions of the connector terminal according to Embodiment 1 are formed.

As shown in FIG. 2, three bottom side contact portions 14A to 14C are formed on a surface of the base member 14 in a flat plate shape. The three bottom side contact portions 14A to 14C are linear contact portions projecting from the surface of the base member 14 in the +Z direction and extending along the Y direction, that is, the fitting axis C1, and are non-spring contact portions that make contact with the bottom surface 21B of the counter connector terminal 21 in the fitted state. The bottom side contact portions 14A to 14C are arranged to form an isosceles triangle T in an XY plane with the center of the bottom side contact portion 14A being set as a vertex A and a line segment connecting the centers of the remaining bottom side contact portions 14B and 14C being set as a base BC.

The base BC of the isosceles triangle T extends in the X direction, and a median AM connecting a midpoint M of the base BC to the vertex A of the isosceles triangle T extends in the Y direction. The isosceles triangle T is symmetrical with respect to a YZ plane passing through the median AM. The median AM of the isosceles triangle T is positioned in the same YZ plane as the YZ plane passing through the fitting axis C1, and the three bottom side contact portions 14A to 14C are arranged symmetrically with respect to the YZ plane passing through the fitting axis C1, i.e., a perpendicular plane that is perpendicular to the top surface 21A of the counter connector terminal 21 in the fitted state and passes through the fitting axis C1.

Figure 3:
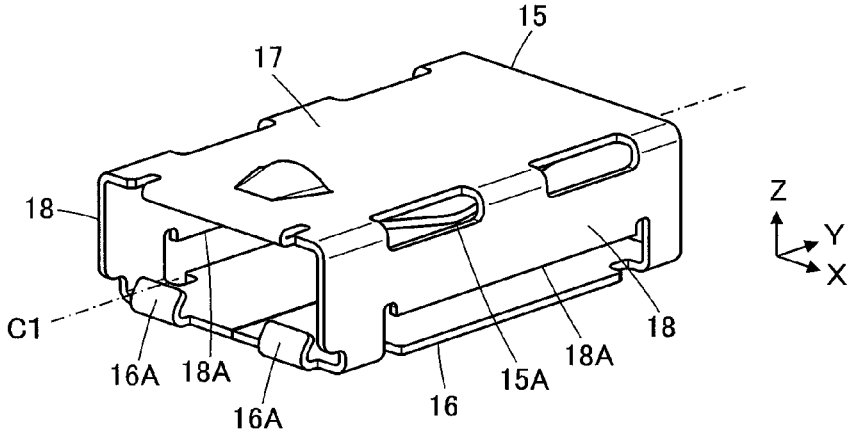
FIG. 3 is a perspective view showing a housing on which a top side contact portion of the connector terminal according to Embodiment 1 is formed.

The structure of the housing 15 is shown in FIG. 3. A pair of claws 16A projecting in the +Z direction and being slightly bent toward the +Y direction are formed at the −Y direction-side end of the bottom plate portion 16 of the housing 15, and a pair of openings 18A lying adjacent to the bottom plate portion 16 and opening along the Y direction are separately formed in the pair of lateral wall portions 18 of the housing 15. The pair of claws 16A and the pair of openings 18A serve to retain the base member 14 in the housing 15. The base member 14 is fixed to the inside of the housing 15 as shown in FIG. 1 with the −Y direction-side end of the base member 14 being caught on the pair of claws 16A and both lateral edges of the base member 14 being inserted in the pair of openings 18A.

A top side contact portion 15A that makes contact with the top surface 21A of the counter connector terminal 21 in the fitted state is formed in the housing 15.

Figure 4:
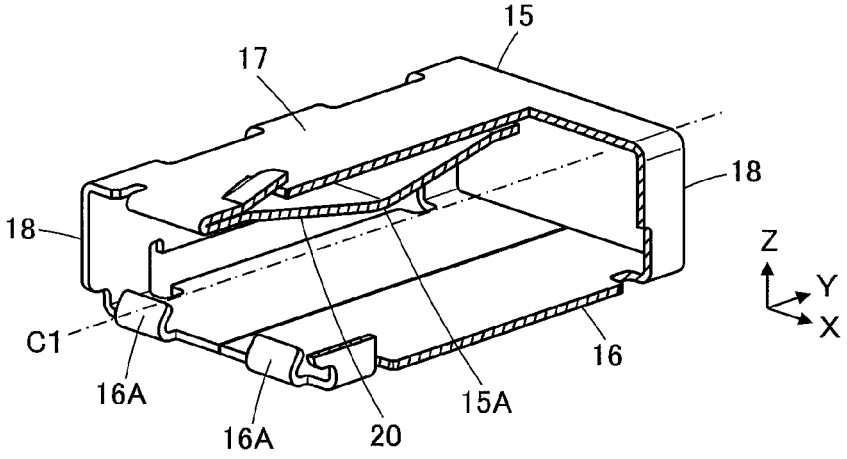
FIG. 4 is a cutaway perspective view showing the inside of the housing used in the connector terminal according to Embodiment 1.
Figure 5:
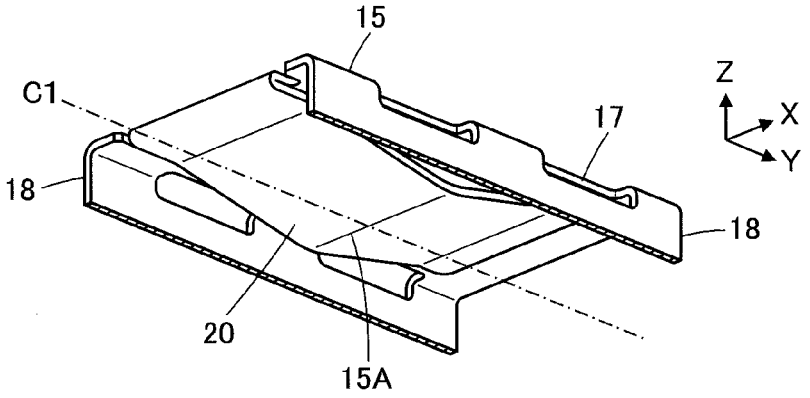
FIG. 5 is a cutaway perspective view showing an upper portion of the housing used in the connector terminal according to Embodiment 1.

FIG. 4 is a drawing showing the inside of the housing 15 with a +X direction-side half of the ceiling portion 17 of the housing 15 and, of the pair of lateral wall portions 18, a +X direction-side lateral wall portion 18 being removed, and FIG. 5 is a drawing showing only a +Z direction-side portion of the housing 15 with a −Z direction-side half of the housing 15 being removed. As shown in FIG. 4, a −Y direction-side end of the ceiling portion 17 of the housing 15 is so bent back inwardly as to extend in the +Y direction, thus forming a plate spring 20 with a V-shaped bent portion at its middle section in the Y direction that projects in the −Z direction. The top side contact portion 15A is formed of the bent portion of the plate spring 20 and, as shown in FIG. 5, constitutes a linear spring contact portion extending over the entire width of the plate spring 20 in the X direction and facing in the −Z direction.

The plate spring 20 is positioned symmetrically with respect to the YZ plane passing through the fitting axis C1 and has a symmetrical shape. The top side contact portion 15A formed of the bent portion of the plate spring 20 is also positioned symmetrically with respect to the YZ plane passing through the fitting axis C1, i.e., a perpendicular plane that is perpendicular to the top surface 21A of the counter connector terminal 21 in the fitted state and passes through the fitting axis C1, as well as having a symmetrical shape.

Figure 6:
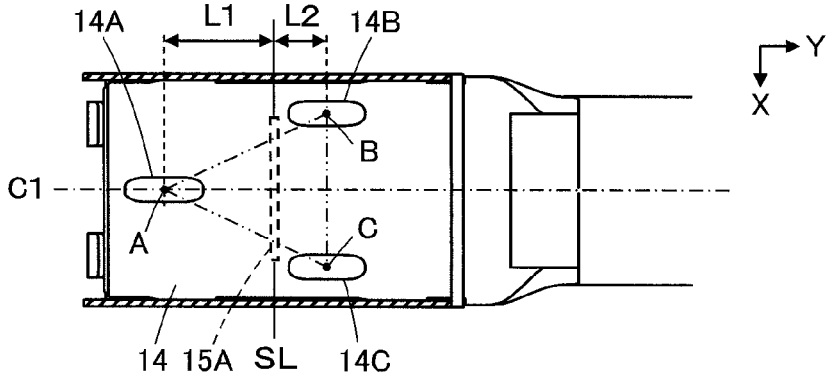
FIG. 6 is a cutaway plan view showing the arrangement of the top side contact portion and bottom side contact portions of the connector terminal according to Embodiment 1.

As shown in FIG. 6, when viewed in the Z direction, that is, a direction perpendicular to the top surface 21A of the counter connector terminal 21 in the fitted state, the top side contact portion 15A is positioned on a straight line SL that lies between the vertex A and the base BC of the isosceles triangle T, which is formed with the centers of the three bottom side contact portions 14A to 14C, and extends parallel to the base BC in such a manner that the ratio of a distance L2 from the base BC to a distance L1 from the vertex A is 1:2.

Figure 7:
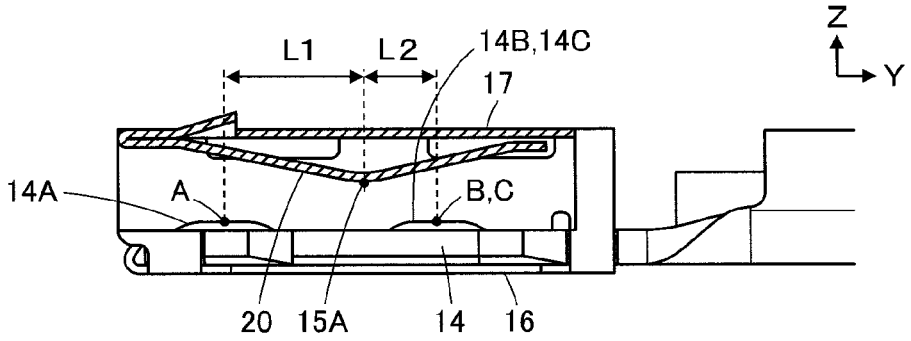
FIG. 7 is a cutaway side view showing the internal structure of the connector terminal according to Embodiment 1.

FIG. 7 is a drawing showing the positional relationship between the top side contact portion 15A of the housing 15 and the bottom side contact portions 14A to 14C of the base member 14 fixed in the housing 15 with the +X direction-side half of the ceiling portion 17 of the housing 15 and, of the pair of lateral wall portions 18, the +X direction-side lateral wall portion 18 being removed similarly to FIG. 4. The top side contact portion 15A and the bottom side contact portions 14A to 14C are arranged so that the distance L1 in the Y direction from the vertex A in the center of the bottom side contact portion 14A to the top side contact portion 15A is twice as long as the distance L2 in the Y direction from the base BC formed with the centers of the bottom side contact portions 14B and 14C to the top side contact portion 15A.

Figure 8:
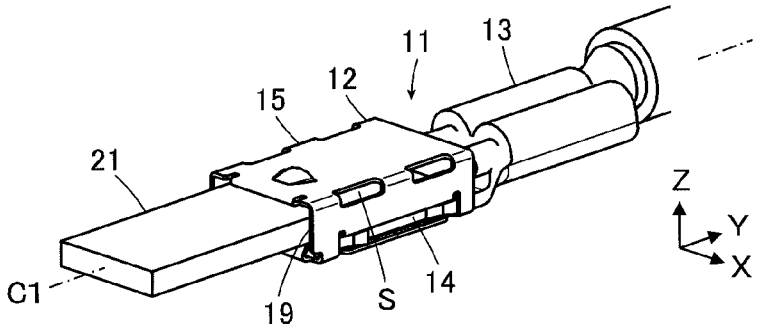
FIG. 8 is a perspective view showing the connector terminal according to Embodiment 1 and the counter connector terminal in the fitted state.

Next, the function of the connector terminal 11 in a fitting process is described. As shown in FIG. 8, when the counter connector terminal 21 is inserted into the counter connector terminal accommodating portion S through the insertion port 19 of the socket portion 12 of the connector terminal 11, the plate spring 20 of the housing 15 is pressed by the counter connector terminal 21 and thereby elastically deforms, and the top side contact portion 15A that is linear and extends in the X direction as shown in FIG. 5 comes into contact with the top surface 21A of the counter connector terminal 21, while the bottom side contact portions 14A to 14C that are arranged on the base member 14, are linear, and extend in the Y direction as shown in FIG. 2 come into contact with the bottom surface 21B of the counter connector terminal 21.

At this time, the insertion of the counter connector terminal 21 causes the plate spring 20 to elastically deform, whereby a contact force N1 is exerted in the −Z direction from the top side contact portion 15A of the housing 15 to the top surface 21A of the counter connector terminal 21. Since the counter connector terminal 21 receives the contact force N1 from the top side contact portion 15A, a load acts on each of the three bottom side contact portions 14A to 14C through the bottom surface 21B of the counter connector terminal 21 in the −Z direction.

As described above, the top side contact portion 15A is positioned symmetrically with respect to the YZ plane passing through the fitting axis C1 and has a symmetrical shape, as well as being positioned on the straight line SL that lies between the vertex A and base BC of the isosceles triangle T, which is formed with the centers of the three bottom side contact portions 14A to 14C, and extends parallel to the base BC in such a manner that the ratio of the distance L2 from the base BC to the distance L1 from the vertex A is 1:2 when viewed in the Z direction.

Accordingly, assuming that the contact force N1 is exerted from the center of the top side contact portion 15A extending in the X direction to the top surface 21A of the counter connector terminal 21 in a concentrated manner, the contact force N1 acts on a point that internally divides the median AM, which connects the midpoint M of the base BC to the vertex A of the isosceles triangle T, in such a manner that the distance L1 from the vertex A is twice as long as the distance L2 from the midpoint M (i.e., L1:L2=2:1). As a result, a load with a magnitude of N1/3 acts on the center of the bottom side contact portion 14A on the vertex A side of the isosceles triangle T, while loads with a magnitude of 2×N1/3 in total act on the centers of the bottom side contact portions 14B and 14C at the base BC side, thereby achieving the balance of forces and the balance of moments. In addition, since the bottom side contact portions 14B and 14C are arranged symmetrically with respect to the YZ plane passing through the fitting axis C1, a load with a magnitude of N1/3 acts on each of the centers of the bottom side contact portions 14B and 14C.

Thus, loads are equally exerted from the bottom surface 21B of the counter connector terminal 21 to the three bottom side contact portions 14A to 14C, which can reduce the variance in contact resistance among the bottom side contact portions 14A to 14C that make contact with the bottom surface 21B of the counter connector terminal 21 in a flat plate shape, thereby preventing heat from being locally generated.

Figure 12:
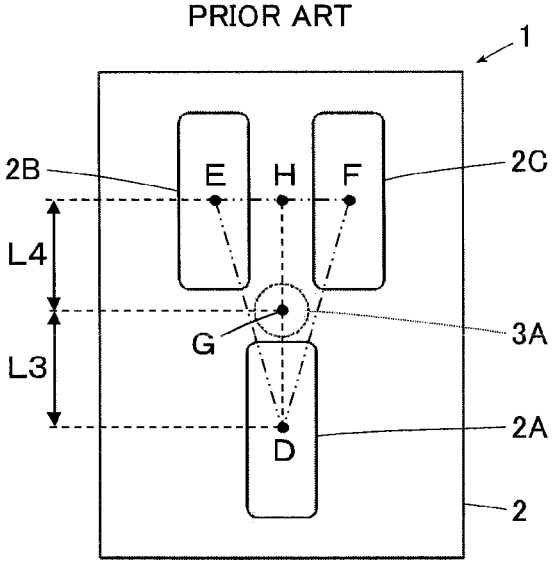
FIG. 12 PRIOR ART
FIG. 12 is a plan view schematically showing the conventional connector terminal.

In contrast, in the conventional connector terminal shown in FIG. 12, although the centers of the three elongate convex contact portions 2A to 2C are arranged to form an isosceles triangle, a distance L3 from the center of the elongate convex contact portion 2A at a vertex D of the isosceles triangle to the center G of the dome-shaped embossed contact 3A is substantially equal to a distance L4 from a midpoint H between the centers of the elongate convex contact portions 2B and 2C at both ends of the base EF of the isosceles triangle to the center G of the dome-shaped embossed contact 3A. Therefore, when a contact force N2 is exerted from the center G of the dome-shaped embossed contact 3A to the plug terminal, a load with a magnitude of N2/2 acts on the center of the elongate convex contact portion 2A at the vertex D, while a load with a magnitude of N2/4 acts on each of the centers of the elongate convex contact portions 2B and 2C at both ends of the base EF. Thus, loads unequally act on the three elongate convex contact portions 2A to 2C, whereby the contact resistance of each of the elongate convex contact portions 2A to 2C varies, which may cause heat to be locally generated.

Embodiment 2

While in Embodiment 1 above, the housing 15 has the top side contact portion 15A extending over the entire width of the plate spring 20 in the X direction, the invention is not limited thereto. For example, as in a connector terminal 31 shown in FIGS. 9 and 10, a pair of top side contact portions 35A may be disposed at the same distance in the +X and −X directions from the YZ plane passing through the fitting axis C1. Those top side contact portions 35A are arranged symmetrically with respect to the YZ plane passing through the fitting axis C1 and have a symmetrical shape.

The connector terminal 31 includes a socket portion 32 and an electric wire holding portion 33 integral with the socket portion 32. The socket portion 32 includes a bottom plate portion 34, a ceiling portion 35 facing the bottom plate portion 34 in parallel therewith, and a pair of lateral wall portions 36 each of which connects either lateral end of the bottom plate portion 34 to the corresponding lateral end of the ceiling portion 35.

The ceiling portion 35 is divided at its center portion along the fitting axis C1 into two upper plate portions 37, and a pair of spring portions 38 having a cantilever shape are formed which is bent at the −Y direction-side end of the upper plate portions 37 toward the inside of the socket portion 32 and extend in the +Y direction. The top side contact portions 35A are separately disposed at the tip ends of the spring portions 38. The pair of spring portions 38 are the same in size and spring constant.

Three bottom side contact portions 34A to 34C are formed on the bottom plate portion 34 of the socket member 32. As with the bottom side contact portions 14A to 14C in Embodiment 1, the bottom side contact portions 34A to 34C are linear and non-spring contact portions projecting from a surface of the bottom plate portion 34 in the +Z direction and extending along the Y direction, that is, the fitting axis C1, and are arranged to form an isosceles triangle in an XY plane with the center of the bottom side contact portion 34A being set as a vertex A and a line segment connecting the centers of the remaining bottom side contact portions 34B and 34C being set as a base BC.

The pair of top side contact portions 35A are, when viewed in the Z direction, positioned on a straight line that lies between the vertex A and base BC of the isosceles triangle, which is formed with the centers of the three bottom side contact portions 34A to 34C, and extends parallel to the base BC in such a manner that the ratio of a distance L2 from the base BC to a distance L1 from the vertex A is 1:2.

Figure 9:
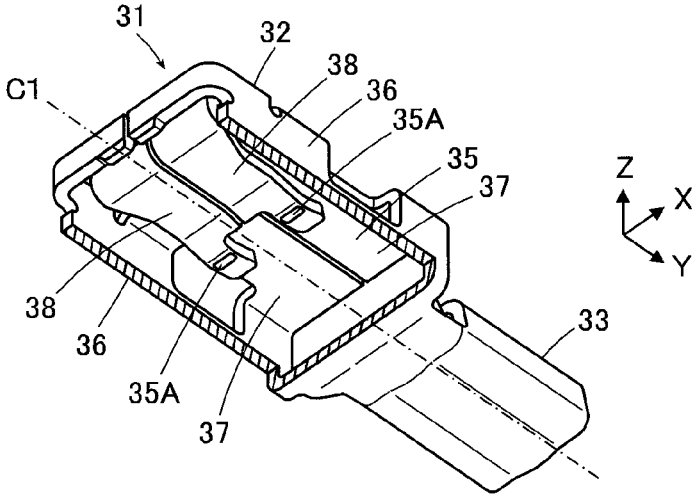
FIG. 9 is a cutaway perspective view showing an upper portion of a connector terminal according to Embodiment 2.
Figure 10:
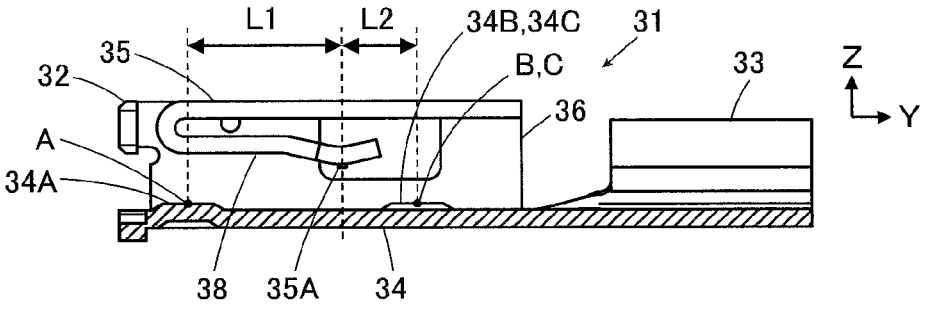
FIG. 10 is a cutaway side view showing the internal structure of the connector terminal according to Embodiment 2.
Figure 11:
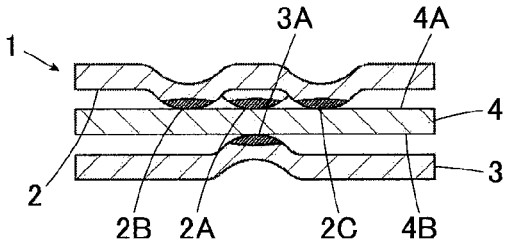
FIG. 11 PRIOR ART
FIG. 11 is a cross-sectional view schematically showing a conventional connector terminal in the fitted state.

While in Embodiment 1 above, the housing 15 having the top side contact portion 15A and the base member 14 having the three bottom side contact portions 14A to 14C are separate components, in the connector terminal 31 of Embodiment 2 shown in FIGS. 9 and 10, the pair of top side contact portions 35A and the three bottom side contact portions 34A to 34C are disposed at the socket portion 32 formed as a single component.

In a fitting process, the insertion of the counter connector terminal 21 causes the pair of spring portions 38 to elastically deform, whereby contact forces of the same magnitude are exerted in the −Z direction from both top side contact portions 35A to the top surface 21A of the counter connector terminal 21, and the resultant force of the two contact forces acts on the middle position between the pair of top side contact portions 35A, i.e., near the fitting axis C1 in the X direction. Therefore, loads are equally exerted to the three bottom side contact portions 34A to 34C, which can reduce the variance in contact resistance, thereby preventing heat from being locally generated.

In addition, since the pair of top side contact portions 35A are disposed at the same distance in the +X and −X directions from the YZ plane passing through the fitting axis C1, when a moment in the XY plane acts on the counter connector terminal 21 fitted with the connector terminal 31, a frictional force is exerted from each of the pair of top side contact portions 35A, which is effective at minimizing displacement of the counter connector terminal 21 in a rotational direction in the XY plane.

Also when a moment about the fitting axis C1 acts on the counter connector terminal 21 fitted with the connector terminal 31, in addition to contact forces exerted from the pair of top side contact portions 35A to the counter connector terminal 21 upon fitting of the counter connector terminal 21, a normal force having a magnitude corresponding to the moment is generated from one of the top side contact portions 35A to the counter connector terminal 21, so that the displacement of the counter connector terminal 21 in a rotational direction in the XZ plane can be minimized.

With a longer distance between the YZ plane passing through the fitting axis C1 and each of the top side contact portions 35A, the configuration more effectively works against a moment exerted to the counter connector terminal 21, thereby minimizing displacement of the counter connector terminal 21 in a rotational direction.

It should be noted that three or more top side contact portions may be provided as long as they are, when viewed in the Z direction, positioned on the straight line that lies between the vertex A and base BC of the isosceles triangle, which is formed with the centers of the three bottom side contact portions 34A to 34C, and extends parallel to the base BC in such a manner that the ratio of the distance L2 from the base BC to the distance L1 from the vertex A is 1:2. Even when, for instance, an external force acts due to vibration or other factors, the provision of two or more top side contact portions serves to minimize displacement of the counter connector terminal 21 relative to the connector terminal 11 whereby the top and bottom side contact portions are prevented from being worn away.

In addition, even with merely a single top side contact portion which is positioned on the straight line that lies between the vertex A and base BC of the isosceles triangle to be parallel to the base BC in such a manner that the ratio of the distance L2 from the base BC to the distance L1 from the vertex A is 1:2 and also positioned in the YZ plane passing through the fitting axis C1, it is possible to reduce the variance in contact resistance by equalizing loads exerted to the three bottom side contact portions 34A to 34C, thereby preventing heat from being locally generated.

For Embodiment 1 above, the configuration may also be employed in which the base member 14 and the housing 15 are integral with each other and the top side contact portion 15A and the three bottom side contact portions 14A to 14C are disposed at the socket portion 12 which is a single component.

Aside from that, while the three bottom side contact portions 14A to 14C in Embodiment 1 and the three bottom side contact portions 34A to 34C in Embodiment 2 are constituted of non-spring contact portions, the contact portions 14A to 14C and 34A to 34C may be spring contact portions as with the top side contact portions 15A and 35A.

What is claimed is:

1. A connector terminal that, when being fitted along a fitting axis with a counter connector terminal in a flat plate shape having a top surface and a bottom surface establishes an electric connection with the counter connector terminal, the connector terminal comprising:

one or more top side contact portions each of which makes contact with the top surface of the counter connector terminal; and three bottom side contact portions each of which is linear, extends along the fitting axis, and makes contact with the bottom surface of the counter connector terminal, wherein the three bottom side contact portions are arranged such that centers of the three bottom side contact portions form an isosceles triangle, and wherein the one or more top side contact portions are, when viewed in a direction perpendicular to the top surface of the counter connector terminal in a fitted state, positioned in a straight line that lies between a base of the isosceles triangle and a vertex of the isosceles triangle facing the base and extends parallel to the base in such a manner that a ratio of a distance from the base to a distance from the vertex is 1:2.

2. The connector terminal according to claim 1, wherein the one or more top side contact portions are each constituted of a linear contact portion extending in parallel with the straight line.

3. The connector terminal according to claim 1, wherein the one or more top side contact portions are positioned symmetrically with respect to a perpendicular plane which is perpendicular to the top surface of the counter connector terminal in the fitted state and passes through the fitting axis, and wherein the three bottom side contact portions are arranged symmetrically with respect to the perpendicular plane.

4. The connector terminal according to claim 3, wherein the one or more top side contact portions are each constituted of a spring contact portion, and wherein the three bottom side contact portions are each constituted of a non-spring contact portion.

5. The connector terminal according to claim 4, wherein the spring contact portion has a symmetrical shape with respect to a plane being parallel to the perpendicular plane and passing through the spring contact portion.

6. The connector terminal according to claim 3, wherein the one or more top side contact portions are each constituted of a bent portion of a bent plate spring.

7. The connector terminal according to claim 1, wherein the one or more top side contact portions comprise a single contact portion.

* * * * *